US009969530B2

(12) United States Patent
Lin

(10) Patent No.: US 9,969,530 B2
(45) Date of Patent: May 15, 2018

(54) ACCORDION-SIDES SQUARE-BOTTOM BAG AND MANUFACTURING METHOD THEREOF

(71) Applicant: Qilin Lin, Guangdong (CN)

(72) Inventor: Qilin Lin, Guangdong (CN)

( * ) Notice: Subject to any disclaimer, the term of this patent is extended or adjusted under 35 U.S.C. 154(b) by 0 days. days.

(21) Appl. No.: 15/123,246

(22) PCT Filed: Feb. 28, 2015

(86) PCT No.: PCT/CN2015/073421

§ 371 (c)(1),
(2) Date: Sep. 1, 2016

(87) PCT Pub. No.: WO2015/131784

PCT Pub. Date: Sep. 11, 2015

(65) Prior Publication Data

US 2017/0057699 A1 Mar. 2, 2017

(30) Foreign Application Priority Data

Mar. 4, 2014 (CN) ..... 2014 1 0076203

(51) Int. Cl.
*B31B 1/90* (2006.01)
*B65D 30/18* (2006.01)
(Continued)

(52) U.S. Cl.
CPC ..... *B65D 31/08* (2013.01); *B31B 70/60* (2017.08); *B65D 31/10* (2013.01); *B31B 2150/00* (2017.08); *B31B 2160/20* (2017.08)

(58) Field of Classification Search
CPC ..... B65D 31/08; B65D 31/10; B31B 70/60; B31B 2150/00; B31B 2160/20
(Continued)

(56) References Cited

U.S. PATENT DOCUMENTS 329,662 A * 11/1885 Lorenz ..... B65D 31/08 383/126
590,559 A * 9/1897 Appel ..... B65D 31/08 383/104

(Continued)

*Primary Examiner* — Jes F Pascua

(57) ABSTRACT

An accordion-sides square-bottom bag and manufacturing method thereof, comprising a paper tube (10) made by a sheet enclosing the sides; accordion sides are folded on two sides of the paper tube (10); the paper tube is provided with a first indentation line (21) and a second indentation line (22), the distance from the second indentation line (22) to the base being greater than the distance between the first indentation line and the second indentation line, but not exceeding twice the distance; two ends of the second indentation line (22) are symmetrically provided with a first crease line (31) and a second crease line (32), the distances between the respective ends of the first and second crease lines and the two edges of the paper tube (10) exceeding the folded depth of the accordion sides; and a first cutting line (41) and a second cutting line (42) are provided from the ends of the first and second crease lines to the base of the paper tube (10). The accordion-sides square-bottom bag enlarges the area of the glued surface of the bottom of the bag, such that the material on the bottom is uniformly distributed, and the bottom is adhered firmly, thus reducing the maximum thickness of the bottom, and reducing the footprint of packaged material during transportation.

2 Claims, 4 Drawing Sheets

(51) Int. Cl.

| | |
|---|---|
| ***B65D 30/20*** | (2006.01) |
| ***B31B 70/60*** | (2017.01) |
| *B31B 150/00* | (2017.01) |
| *B31B 160/20* | (2017.01) |

(58) Field of Classification Search
USPC ..... 383/120, 126
See application file for complete search history.

(56) References Cited

U.S. PATENT DOCUMENTS

| | | | | | |
|---|---|---|---|---|---|
| 692,695 | A | * | 2/1902 | Mullen | B31B 37/00 493/241 |
| 2,246,911 | A | * | 6/1941 | Baker | B65D 31/08 383/114 |
| 2,353,605 | A | * | 7/1944 | Waters | B65D 31/08 383/126 |
| 2,444,762 | A | * | 7/1948 | Waters | B65D 31/08 383/126 |
| 2,600,487 | A | * | 6/1952 | Craig | B65D 31/08 383/115 |
| 2,845,849 | A | * | 8/1958 | Hahn | B31B 70/00 383/126 |
| 3,025,768 | A | * | 3/1962 | Kessler | B31B 70/00 493/241 |
| 3,734,395 | A | * | 5/1973 | Erk | B65D 31/08 383/110 |

* cited by examiner

ACCORDION-SIDES SQUARE-BOTTOM BAG AND MANUFACTURING METHOD THEREOF

BACKGROUND OF THE INVENTION

The present invention relates to a kind of packaging bag and a manufacturing method thereof, and more specifically relates to an accordion-sides square-bottom bag and a manufacturing method thereof.

Square-bottom bags are widely used in various occasions for carrying objects or serving promotional purposes etc. An existing method of manufacturing an accordion-sides square bottom bag is to use a single piece of plane paper, make indentation lines on the paper, form a suitable outer contour by punching, fold the paper into a cylinder shape according to the indentation lines, glue the edges of paper to form a cylinder, make accordion folds on the cylinder, glue up the bottom part of the cylinder after folding the bottom edge of the cylinder by using glue or heat bonding method to form a square-bottom bag. Said manufacturing method is not effective. An alternative method is a continuous manufacturing method wherein rolled paper is used; edges of the rolled paper are sealed to form a cylinder and at the same time, accordion folds are made by using shaping die cutting molds; after that, cut the roll of paper into sections, fold the bottom part of each section, glue up each bottom part by glue or heat bonding to form a square-bottom bag for each section. Due to machining process of the entire roll of paper (e.g. by gravure) where edges of the paper are sealed along the entire roll of paper to form sections of cylinders and the accordion folds are continuously made, said method has a high efficiency. However, said method does not process indentation lines on the paper, therefore the bottom part of each section is not accurately formed, and the choices of materials for making the bag are limited. The two methods as described above generally produce a bag as shown in FIGS. 1-2. The formed bottom after folding process has a total of five layers, thereby thickening the bottom part; also, the layers are unevenly distributed, and the surface area for gluing or heat bonding is small, thereby leaving gaps in the middle and thus failing to achieve strong and reliable bonding; further when a plurality of such bags are stacked up, they take up a large amount of space.

BRIEF SUMMARY OF THE INVENTION

The technical solution offered by the present invention is to provide an accordion-sides square-bottom bag and a manufacturing method thereof. The accordion-sides square-bottom bag provided by the present invention has a thin and firmly bonded bottom.

To fulfill the above object, the present invention provides an accordion-sides square-bottom bag, constituted by a paper cylinder formed by sealing two edges of a sheet of paper material; two sides of the paper cylinder are formed with two accordion folds respectively; a first indentation line and a second indentation line parallel to a bottom edge of the paper cylinder are provided on the paper cylinder; a distance between the second indentation line and the bottom edge of the paper cylinder is greater than a distance between the first indentation line and the second indentation line, but does not exceed twice the distance between the first indentation line and the second indentation line; a first crease line and a second crease line are symmetrically provided respectively at two respective ends of the second indentation line; the first crease line and the second crease line do not touch the bottom edge of the paper cylinder; two distances from ending points of the first crease line and the second crease line to their respective proximate sides of the two sides of the paper cylinder are respectively greater than respective folding depths of the accordion folds at the two sides of the paper cylinder; the ending points of the first crease line and the second crease line are joined with one end of the first cutting line and one end of the second cutting line respectively; another end of the first cutting line and another end of the second cutting line contact the bottom edge of the paper cylinder.

Further, the distance between the first indentation line and the second indentation line is the same as either one of the folding depths of the accordion folds.

Further, the first crease line and the second crease line form two angles of 45 degrees with respect to the two sides of the paper cylinder respectively.

Further, the first cutting line and the second cutting line are perpendicular to or intersect with the bottom edge of the paper cylinder.

Further, the first cutting line and the second cutting line are straight lines or curved lines.

Further, the first cutting line and the second cutting line are complete lines or incomplete lines.

Further, the first crease line and the second crease line are complete lines or incomplete lines.

The present invention has correspondingly provided a method of manufacturing an accordion-sides square-bottom bag, comprising the following steps:

Step 1: sealing two edges of a sheet of paper material to form a paper cylinder; forming accordion crease lines for accordion folds on the paper cylinder by punching or rolling; forming accordion folds to form the paper cylinder which has the accordion folds;

Step 2: forming a first indentation line and a second indentation line on the paper cylinder having the accordion folds by punching or rolling, wherein the first indentation line and the second indentation line are parallel to a bottom edge of the paper cylinder, and wherein a distance between the second indentation line and the bottom edge of the paper cylinder is greater than a distance between the first indentation line and the second indentation line, but does not exceed twice the distance between the first indentation line and the second indentation line;

Step 3: forming a first crease line and a second crease line symmetrically by pressing, with their starting points begin at two respective ends of the second indentation line, wherein the first crease line and the second crease line do not touch the bottom edge of the paper cylinder; and wherein the first crease line and the second crease line form two angles of 45 degrees with respect to two sides of the paper cylinder respectively, and wherein two distances from ending points of the first crease line and the second crease line to their respective proximate sides of the two sides of the paper cylinder are respectively greater than respective folding depths of the accordion folds at the two sides of the paper cylinder;

Step 4: joining the ending points of the first crease line and the second crease line with one end of the first cutting line and one end of the second cutting line respectively, while another end of the first cutting line and another end of the second cutting line contact the bottom edge of the paper cylinder, and wherein cutting performed along the first cutting line enables two surfaces of the paper cylinder to be cut simultaneously, and cutting performed along the second cutting line also enables the two surfaces of the paper cylinder to be cut simultaneously.

Further, the first indentation line, the second indentation line, the first crease line and the second crease line are complete lines or incomplete lines.

Further, the present invention comprises the following steps of folding the paper cylinder:

Flipping a front surface of the paper cylinder upward from the bottom edge of the paper cylinder and folding the front surface upward along the first indentation line, while side edges of the accordion folds between both the front surface and a back surface of the bottom edge of the paper cylinder are pressed and folded;

Downwardly folding the front surface being flipped and folded upward along the first indentation line along a first sub-second indentation line; upwardly folding the back surface which has not been folded previously along a second sub-second indentation line; applying adhesives to adhere a downwardly folded portion of the front surface and an upwardly folded portion of the back surface, or bonding the downwardly folded portion of the front surface and the upwardly folded portion of the back surface by heat bonding.

The present invention has the following beneficial effects: The present invention enlarges the bonding surface area of the bottom part of the packaging bag in order that the bottom part can be firmly bonded. Also, the bottom part of the packaging bag has four layers, thereby reducing the thickness of the bottom part. When multiple numbers of such bags are stacked up, the total height of the bags after stacking is reduced, thereby reducing the amount of space occupied by the bags during storage and transportation.

DETAILED DESCRIPTION OF THE INVENTION

The present invention will be further described in detail below with reference to the drawings with a view to clearly illustrating the object, technical scheme and advantages of the present invention.

Figure 1:
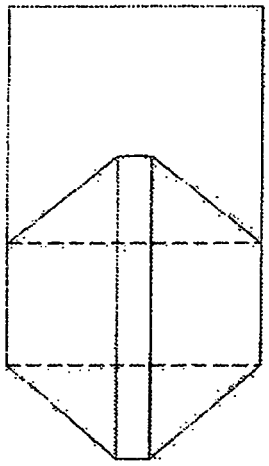
FIG. 1 is a schematic structural view of an accordion-sides square-bottom bag according to prior arts.
Figure 2:
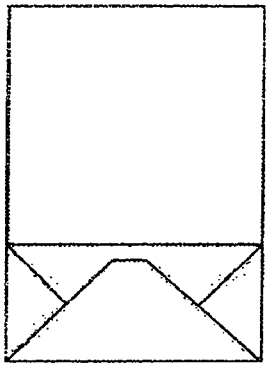
FIG. 2 shows a square bottom of the prior art accordion-sides square-bottom bag illustrated in FIG. 1.
Figure 3:
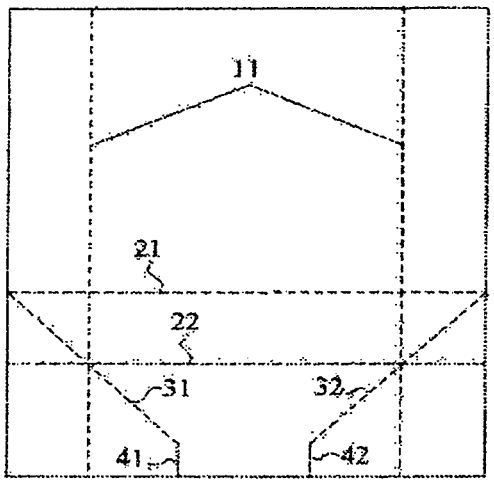
FIG. 3 is a structural view of the present invention in an unfolded condition.

FIG. 3 is a schematic structural view showing a paper cylinder formed by sealing two edges of a sheet of paper material.

According to an embodiment of the present invention, an accordion-sides square-bottom bag is constituted by a paper cylinder 10 formed by sealing two edges of a sheet of paper material; when the paper cylinder 10 is flattened, two accordion crease lines 11 are provided near to two sides of the paper cylinder 10 respectively for creating accordion folds, a lower part of the paper cylinder 10 is provided with a first indentation line 21 and a second indentation line 22, both of which being parallel to a bottom edge of the paper cylinder 10; a distance between the second indentation line 22 and the bottom edge of the paper cylinder 10 is greater than a distance between the first indentation line 21 and the second indentation line 22, but does not exceed twice the distance between the first indentation line 21 and the second indentation line 22; the distance between the first indentation line 21 and the second indentation line 22 is the same as a folding depth of either one of the accordion folds.

Figure 4:
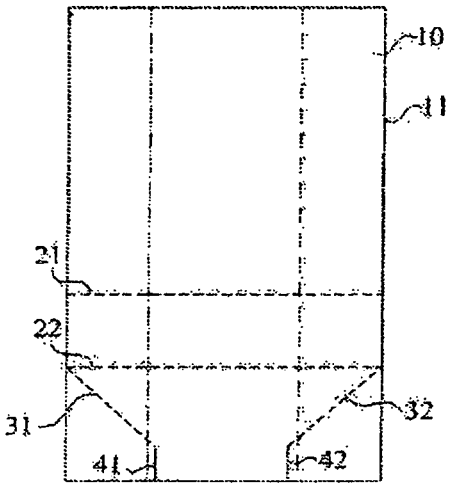
FIG. 4 shows the pressing, folding and cutting lines appearing on a front surface of the paper cylinder after accordion folds are made on two sides of the paper cylinder.

With reference to the schematic structural view shown in FIG. 4, a first crease line 31 and a second crease line 32 are symmetrically provided with their starting points begin at two respective ends of the second indentation line 22; the first crease line 31 and the second crease line 32 do not touch the bottom edge of the paper cylinder 10; the first crease line 31 and the second crease line 32 form two angles of 45 degrees with respect to the two sides of the paper cylinder 10 respectively.

It should be noted that, two distances from ending points of the first crease line 31 and the second crease line 32 to their respective proximate accordion crease lines 11 are respectively greater than two distances from the accordion crease lines 11 to their respective proximate sides of the paper cylinder 10.

The ending points of the first crease line 31 and the second crease line 32 are joined with one end of the first cutting line 41 and one end of the second cutting line 42 respectively; another end of the first cutting line 41 and another end of the second cutting line 42 contact the bottom edge of the paper cylinder 10; cutting performed along the first cutting line 41 enables two surfaces of the paper cylinder 10 to be cut simultaneously, and cutting performed along the second cutting line 42 also enables the two surfaces of the paper cylinder 10 to be cut simultaneously; the first cutting line 41 and the second cutting line 42 may be embodied as being perpendicular to the bottom edge of the paper cylinder 10 or intersect with the bottom edge of the paper cylinder 10; the first cutting line 41 and the second cutting line 42 may be straight lines or curved lines. In the present embodiment, the first cutting line 41 and the second cutting line 42 are embodied as straight lines which are perpendicular to the bottom edge of the paper cylinder 10.

It should be noted that, the first indentation line 21 and the second indentation line 22 can be complete lines or incomplete lines. In the present embodiment, the first indentation line 21 and the second indentation line 22 are complete lines. An example of an incomplete line is that the line is remained at two ends but omitted in the middle, which is enough to facilitate folding. Likewise, the first crease line 31 and the second crease line 32 may also be complete lines or incomplete lines. In the present embodiment, the first crease line 31 and the second crease line 32 are complete lines. It is understood that the present invention should not be limited to the specific embodiment disclosed herein.

The present embodiment also discloses a manufacturing method of manufacturing the described accordion-sides square-bottom bag, comprising the steps of sealing two edges of a sheet of paper material to form a paper cylinder, as shown in FIG. 3; forming accordion crease lines 11 for accordion folds on the paper cylinder by punching or rolling after sealing the edges; forming accordion folds to form the paper cylinder 10 as shown in FIG. 4; forming a first indentation line 21 and a second indentation line 22 at a lower portion of the paper cylinder 10 by punching or rolling, wherein a distance between the first indentation line 21 and the second indentation line 22 is the same as a distance between either one of the accordion crease lines 11 and a respective side edge of the paper cylinder proximate to said either one of the accordion crease lines 11; the first indentation line 21 and the second indentation line 22 are parallel to a bottom edge of the paper cylinder 10.

It should be noted that, a distance between the second indentation line 22 and the bottom edge of the paper cylinder 10 is greater than the distance between the first indentation line 21 and the second indentation line 22, but does not exceed twice the distance between the first indentation line 21 and the second indentation line 22.

Forming a first crease line 31 and a second crease line 32 whose two starting points are at two respective intersections between two ends of the first indentation line 21 and two respective sides of the paper cylinder 10; the first crease line 31 and the second crease line 32 run along respectively across two respective intersections between two ends of the second indentation line and two respective accordion crease lines 11; the first crease line 31 and the second crease line 32 do not touch the bottom edge of the paper cylinder 10; the first crease line 31 and the second crease line 32 form two angles of 45 degrees with respect to the two sides of the paper cylinder 10 respectively.

It should be noted that, two distances from two ending points of the first crease line 31 and the second crease line 32 to their respective proximate accordion crease lines 11 are respectively greater than two distances from the accordion crease lines 11 to their respective proximate sides of the paper cylinder 10.

The ending points of the first crease line 31 and the second crease line 32 are joined with one end of a first cutting line 41 and one end of a second cutting line 42 respectively; another end of the first cutting line 41 and another end of the second cutting line 42 contact the bottom edge of the paper cylinder 10; cutting performed along the first cutting line 41 enables two surfaces of the paper cylinder 10 to be cut simultaneously, and cutting performed along the second cutting line 42 also enables the two surfaces of the paper cylinder 10 to be cut simultaneously; portions between the first cutting line 41 and the second cutting line 42 are the major adhering portions of the present invention.

It should be noted that, the first indentation line 21 and the second indentation line 22 can be complete lines or incomplete lines. In the present embodiment, the first indentation line 21 and the second indentation line 22 are preferably complete lines. Likewise, the first crease line 31 and the second crease line 32 may also be complete lines or incomplete lines. In the present embodiment, the first crease line 31 and the second crease line 32 are preferably complete lines. It is understood that the present invention should not be limited to the specific embodiment disclosed herein.

Figure 5:
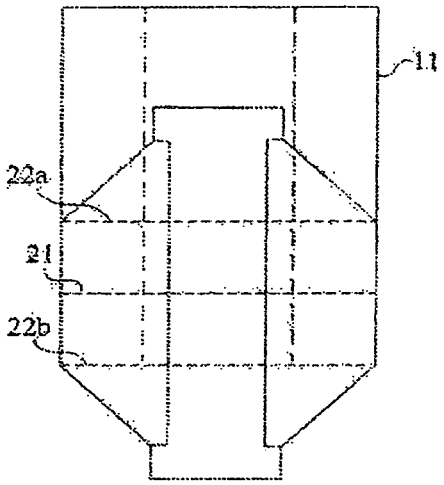
FIG. 5 shows a partially folded condition of the square bottom of the accordion-sides square-bottom bag of the present invention.

The paper cylinder is first folded with accordion folds at two sides along the accordion crease lines 11 to form the structure shown in FIG. 4. After that, a front surface of the paper cylinder is flipped upward from the bottom edge of the paper cylinder and folded along the first indentation line 21, while side edges of the accordion folds between both the front surface and a back surface of the bottom edge of the paper cylinder are pressed and folded to form the structure shown in FIG. 5.

Figure 6:
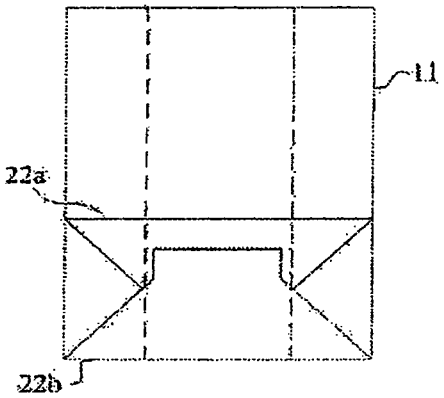
FIG. 6 shows a completely folded condition of the square bottom of the accordion-sides square-bottom bag of the present invention.
Figure 7:
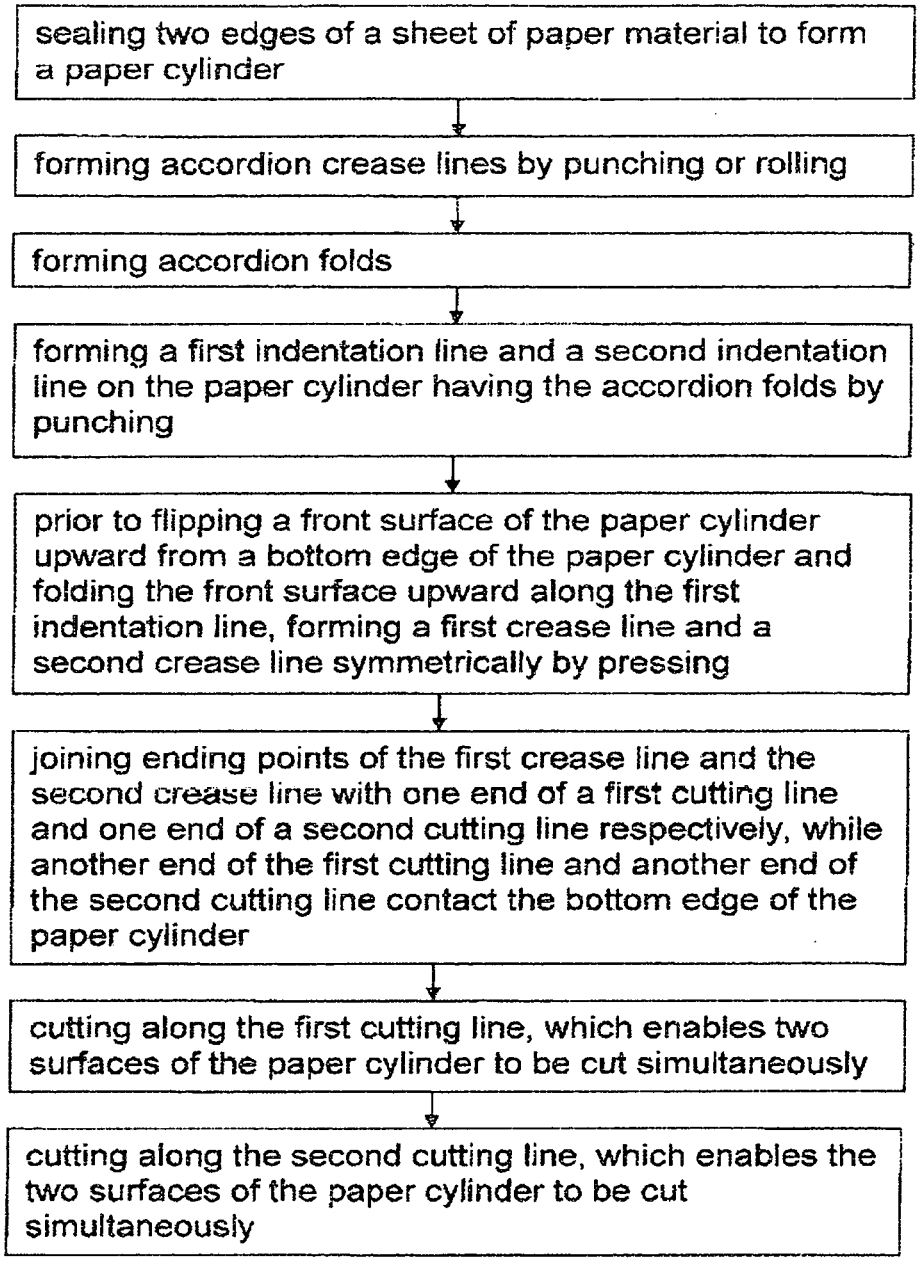
FIG. 7 is a flow chart showing a method of manufacturing the accordion-sides square-bottom bag according to the present invention.

An upper part of the front surface of the paper cylinder being flipped upward and folded along the first indentation line 21 is folded downward along a first sub-second indentation line 22*a*. Likewise, the back surface of the paper cylinder is folded upward along a second sub-second indentation line 22*b*. Adhesives are applied to a portion of a folded part which is folded later and also to any necessary portion in order to achieve bonding. Bonding may also be achieved by direct heat bonding. As such, a bottom part of the bag is manufactured as shown in FIG. 6.

It should be noted that the first indentation line 21, the second indentation line 22, the first crease line 31, the second crease line 32, the first cutting line 41, the second cutting line 42 and the section lines on a roll of paper material for dividing the paper material into sections of cylinders in continuous manufacturing can be formed by one-time pressing so as to increase manufacturing efficiency. No further limitation to this feature will be made in the present invention.

The present invention solves the problems existing in the current technology of manufacturing accordion-sides square-bottom bag. The present invention has balanced product performance, product appearance and manufacturing efficiency, ensuring firm adhesion of the bottom part of the bag and the preciseness and aesthetic appearance of the bag while enhancing manufacturing efficiency. Further, the bottom part of the bag has a decreased thickness to reduce storage space and transport cost. The present invention is more suitable for use with automatic packaging machine due to reduced thickness and precise dimensions.

A preferred embodiment of the present invention is described above. It should be noted that a person skilled in this field of art may modify and refine the present invention without deviating from the principle of the present invention, and these modification and refinement should also fall within the scope of protection of the present invention.

What is claimed is:

1. A method of manufacturing the accordion-sides square-bottom bag; the accordion-sides square-bottom bag is constituted by a paper cylinder formed by sealing two edges of a sheet of paper material; two sides of the paper cylinder are formed with two accordion folds respectively; a first indentation line and a second indentation line parallel to a bottom edge of the paper cylinder are formed on the paper cylinder; a distance between the second indentation line and the bottom edge of the paper cylinder is greater than a distance between the first indentation line and the second indentation line, but does not exceed twice the distance between the first indentation line and the second indentation line; a first crease line and a second crease line are symmetrically provided respectively at two respective ends of the second indentation line; the first crease line and the second crease line do not touch the bottom edge of the paper cylinder; two distances from ending points of the first crease line and the second crease line to their respective proximate sides of the two sides of the paper cylinder are respectively greater than respective folding depths of the accordion folds at the two sides of the paper cylinder; the ending points of the first crease line and the second crease line are joined with one end of a first cutting line and one end of a second cutting line respectively; another end of the first cutting line and another end of the second cutting line contact the bottom edge of the paper cylinder;

wherein the method comprises the following steps:

step 1: sealing the two edges of the sheet of paper material to form the paper cylinder; forming accordion crease lines for the accordion folds on the paper cylinder by punching or rolling; forming the accordion folds to form the paper cylinder which has the accordion folds;

step 2: after step 1 and before step 3, forming the first indentation line and the second indentation line on the paper cylinder having the accordion folds by punching;

step 3: after step 2 and prior to flipping a front surface of the paper cylinder upward from the bottom edge of the paper cylinder and folding the front surface upward along the first indentation line, forming the first crease line and the second crease line symmetrically by pressing, with their starting points begin at two respective ends of the second indentation line; wherein the first crease line and the second crease line form two angles of 45 degrees with respect to the two sides of the paper cylinder respectively;

step 4: joining the ending points of the first crease line and the second crease line with one end of the first cutting line and one end of the second cutting line respectively, while another end of the first cutting line and another end of the second cutting line contact the bottom edge of the paper cylinder, and wherein cutting performed along the first cutting line enables two surfaces of the paper cylinder to be cut simultaneously, and cutting performed along the second cutting line also enables the two surfaces of the paper cylinder to be cut simultaneously.

2. The method according to claim 1, wherein the first cutting line, the second cutting line, the first crease line and the second crease line are complete lines.

* * * * *